US006379213B2

(12) United States Patent
Whitworth

(10) Patent No.: US 6,379,213 B2
(45) Date of Patent: Apr. 30, 2002

(54) INVERTED PIVOT

(76) Inventor: Michael W. Whitworth, 1017 Romine, Kirkwood, MO (US) 63122

( * ) Notice: Subject to any disclaimer, the term of this patent is extended or adjusted under 35 U.S.C. 154(b) by 0 days.

(21) Appl. No.: 09/795,514

(22) Filed: Feb. 27, 2001

Related U.S. Application Data

(60) Provisional application No. 60/185,487, filed on Feb. 28, 2000.

(51) Int. Cl.[7] ..... A63H 18/00; A63H 19/02; A63H 33/26

(52) U.S. Cl. ..... 446/444; 446/465; 446/467; 446/138

(58) Field of Search ..... 446/431, 444, 446/465, 466, 467, 138

(56) References Cited

U.S. PATENT DOCUMENTS 2,847,798 A * 8/1958 Orel ..... 446/444
2,939,245 A * 6/1960 Orel ..... 446/138
3,330,066 A * 7/1967 Crawford ..... 446/138
3,660,927 A * 5/1972 De Christopher ..... 446/426
3,850,310 A * 11/1974 Osthall ..... 213/75 TC
4,583,955 A * 4/1986 Toloczko ..... 446/467
5,048,704 A * 9/1991 Takahashi ..... 446/138
5,427,561 A * 6/1995 Eichhorn et al. ..... 446/444
5,681,202 A * 10/1997 Sander ..... 446/138

* cited by examiner

*Primary Examiner*—Jacob K. Ackun, Jr.
*Assistant Examiner*—Shaquita McConnell
(74) *Attorney, Agent, or Firm*—Paul M. Denk

(57) ABSTRACT

A railroad car incorporating a pair of wheel carriages, each wheel carriage holding four wheels, and pivotally connected to a housing 8, the housing having a lower clearance passage provided through its bottom, an upper longitudinally inclined slot, opening to its top, and an aperture therethrough, and through which a fastener may locate, for pivotal securement of the wheel carriage to the underside of a railroad car.

6 Claims, 2 Drawing Sheets

INVERTED PIVOT

CROSS REFERENCE TO RELATED APPLICATION

This application is a non-provisional patent application based upon provisional patent application having Ser. No. 60/185,487, filed on Feb. 28, 2000.

STATEMENT OF REGARDING FEDERALLY SPONSORED RESEARCH OR DEVELOPMENT

N/A

BACKGROUND OF INVENTION

1. Field of Invention

Although the inverted pivot methodology may be applicable to any requirement for rotational movement around a displaced axis, its development was driven by a requirement to maximize the length of wooden toy railcars while maintaining their ability to successfully navigate most commercially available wooden railroad curved tracks, switches, inclines and bridges.

2. Description of Prior Art

Currently the overall length of wooden toy railcars is limited by the steepness of the traditional industry inclines (hills, overpasses, etc.). Maximum inclines measure 28 to 32 degrees. The transition from flat track to these inclines is very rapid and two axle toy railcars longer than three inches tend to make coupler contact with the track while beginning the incline which ultimately derails the railcar. This same undesirable track contact and derailment also occurs at the toy railcar's retransition from incline to level track. In the case of inclines associated with the inverted "U" or hump shaped overpass track, the length of the railcar additionally becomes a limiting factor because the underside of extended length toy railcars tend to drag at the pinnacle of the incline.

To date the wooden toy train industry has taken three basic approaches to this problem.

1. One is to use oversized wheels and to move them closer to each car end. Use of oversized wheels allows the railcar to enter the incline transition by holding the car body well above the track and, thus, avoiding undesirable contact with the track. However, this application is currently limited to two axle railcars and even these toy railcars do not successfully navigate the "hump shaped" trace accessory. Maximum car length is about 3.5 inches. The use of oversized wheels is not desirable because their size in proportion to the railcar body greatly degrades the realism of the toy because the overall height of the toy railcar remains fixed, and thus, the railcar body takes on the appearance of little more than a stick with wheels.
2. A second approach is to use wheel track technology similar to that on full scale railcars. Current wooden toy railroad industry wheel trucks, again, use oversize wheels and a "T" shaped pivot pin located in the top of the wheel truck. In this application, the stem of the "T" is secured into a bearing housing in the railcar underbody along the "y" axis and the top of the "T" is positioned in the wheel truck along the wheel truck's "z" axis. The wheel truck pivots around both the "y" and "z" axis. While this approach allows the use of a more realistic wheel configuration (wheel trucks vs. two axle) and somewhat longer toy railcars (approx.4+ inches); the disproportional, oversized wheels again detract from the railcars realism as in Item 1 above. This second approach is also bound by the same maximum railcar height limitation as above and, thus, is still relegated to using the undesirable "stick on wheels" appearance.
3. An industry third approach is to use a "rocker" wheel truck assembly. In this approach, the top of the wheel truck has two flat, slightly declining surfaces which, when attached to the railcar with the use of a pivot pin, allows the wheel truck to "rock" or pivot along the "z" axis and spin on the "y" axis. The top of the wheel truck is permanently attached to the underside of the railcar along the "y" axis. However, this third approach also requires to use oversized wheels and, thus, the "stick on wheels" appearance.

The object of this inverted pivot invention is to provide a new wheel truck assembly using geometry that will allow extended length toy wooden railcars (5 to 6 inches) to successfully navigate the wooden toy train industry's standard inclined track configurations.

Another object of this invention is to provide a new wheel truck assembly which allows for the use of small diameter wheels, which, in turn, allows for more realistic appearing toy railcars.

SUMMARY OF THE INVENTION

In accordance with the teachings of this invention, the use of inverted pivot wheel truck assembly allows:

1. more realistic wooden toy railcars;
2. railcars exceeding five inches or more to successfully navigate steep track inclines including the "hump" shaped overpass configuration as described above. The invention may be made of any appropriately configured rigid material.

DESCRIPTION OF THE PREFERRED EMBODIMENT

Figures 1, 2, 3:
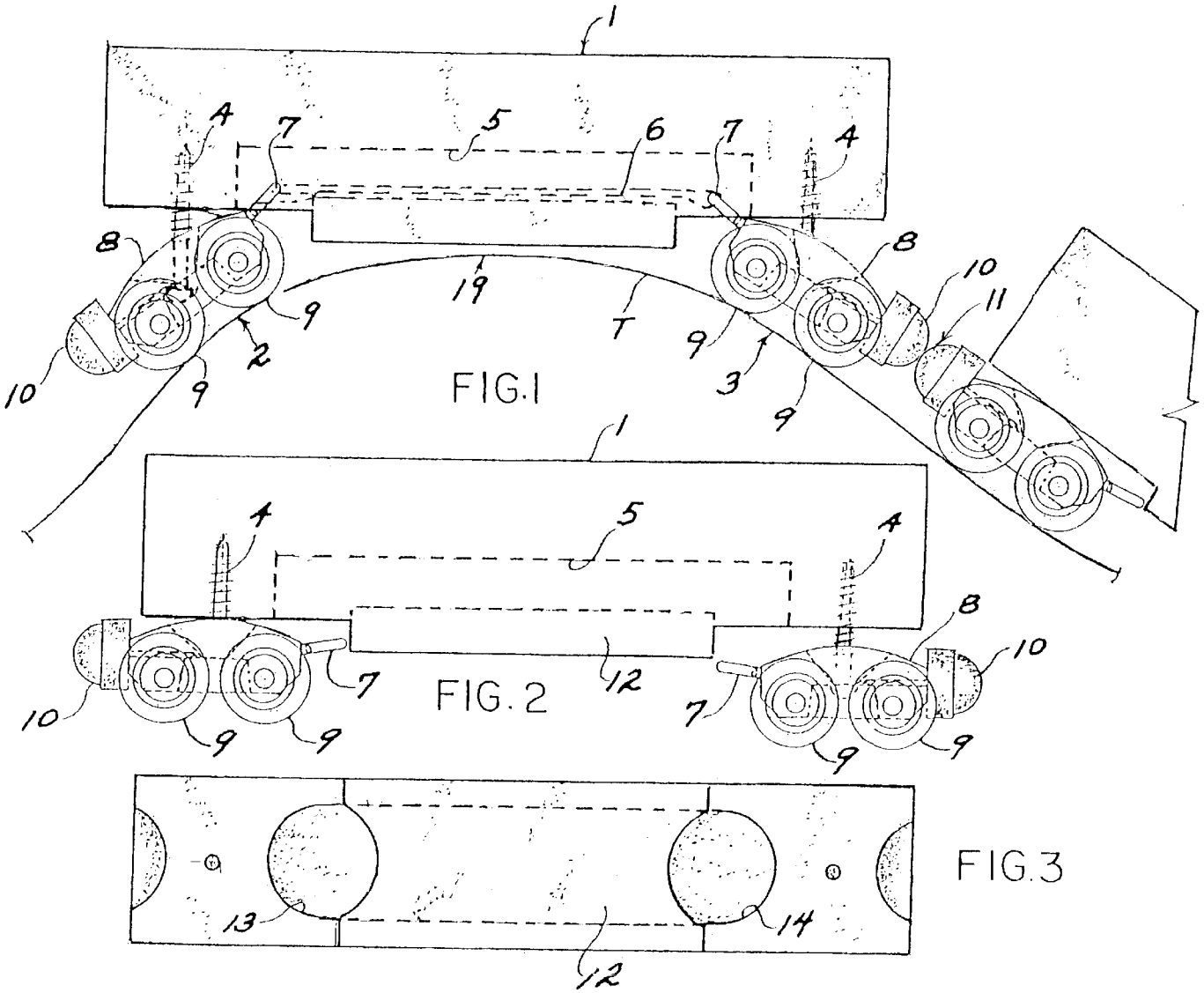
FIG. 1 is a side view of a toy railroad car incorporating the inverted pivot for supporting the wheels of this invention, disclosing how they compensate for allowing the car to travel over a rise or hill.
FIG. 2 is a side view of the railroad car.
FIG. 3 is a bottom view of the railroad car, with the wheels removed.
Figure 4:
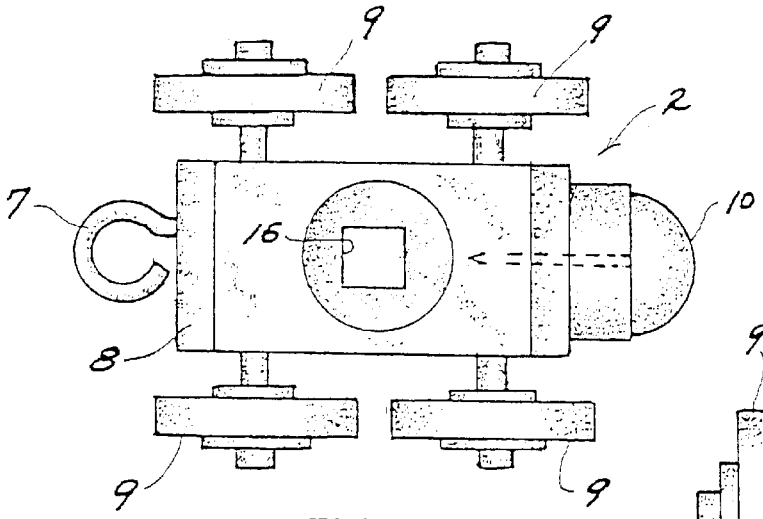
FIG. 4 is a bottom view of the wheel carriage.
Figure 7:
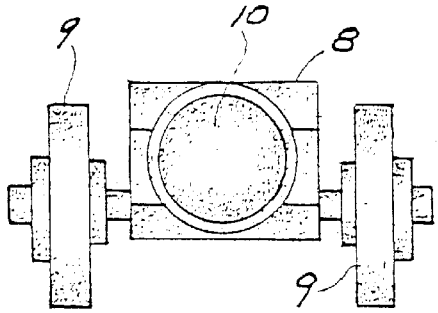
FIG. 7 a front view thereof.

As can be seen in FIG. 1, the railroad car 1 of this invention is disclosed, in this particular instance, riding over a crest or hill and upon tracks, as at T, during usage. The railroad car 1 includes a pair of wheel carriages 2 and 3, and each wheel carriage is held by an anchor or screw 4 to the underside of the car 1. There is a clearance slot 5 provided within the car, located at its undersurface, and this furnishes spacing for use of a resilient means, as at 6, that interconnects between a pair of eyelets 7 that connect to each of the wheel carriages 2 and 3, as can be noted. Thus, this provides some degree of resiliency and control between the two wheel carriages, located at the underside of the railroad car 1, during their usage and application. As can be seen, each wheel carriage includes a mount 8, and supports four car wheels 9 for each wheel carriage 2 or 3. At the front and back of each wheel carriage is provided an enlarged boss 10, and which is magnetically treated, so as to provide for a magnetic connection between adjacent cars, as can be seen at 11 in FIG. 1.

As can further be noted, there is a cover 12 provided at the underside of each car 1, and which furnishes some degree of coverage to the resilient means 6, with the resilient means extending internally within the passage 5 through the openings 13 and 14, as can be noted upon the bottom side of each railroad car, as can be seen in FIG. 3.

Figure 9:
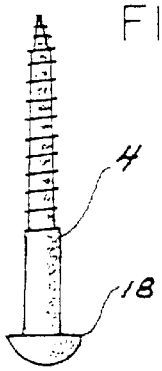
FIG. 9 is a view of a anchor for mounting the wheels to the underside of the railroad car.
Figure 10:
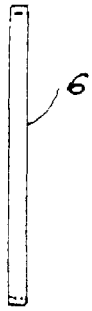
FIG. 10 shows the resilient means, namely, a rubber type band, for use for holding a pair of the railroad wheels together.

As can be seen from FIGS. 4 through 8, and the essence of the invention provided herein, is to form various slots and grooves within the interior of each of the wheel carriage 2 or 3. These passages, as can be noted, include a counterbore, as at 15, provided to the bottom of each carriage, and which communicates at its neck 16 with an elongated slot 17 that opens to the top side of each wheel carriage, as noted. Thus, when a fastener 4, as disclosed in FIG. 9, locates into the opening 15, and extends through the neck 16, the head 18 of the fastener is of sufficient size to prevent the head from passing through the neck 16, as it fastens the wheel carriage to the underside of the railroad car, as can be noted in FIG. 1. But, as can further be seen from FIG. 1, as the railroad car passes over a crest, or perhaps moves through a valley, the wheel carriages are allowed to pivot longitudinally, or from front to back, even though secured by the fastener 4 to the underside of the railroad car, since clearance is provided by means of the inclined elongated slot 17, that opens to the top of each wheel carriage, as can be noted in FIG. 6. Hence, if the wheels are fixed, the car has a difficult time passing over a crest, or moving through a valley, when riding upon its tracks T. But, due to the pivot provided in the mounting of the wheel carriages 2 and 3 to the underside of the railroad car, the car is allowed to pass through these difficult positions, because the wheel carriage may pivot, and allow the railroad car to attain sufficient clearance, as can be seen at 19, in FIG. 1.

The foregoing provides the structural analysis of the components that make up the railroad car of this invention, with its inverted pivot wheel carriages mounted thereunder, and which accommodate and facilitate the movement of the railroad car through difficult locations, whether it be over a crest of a hill as shown in FIG. 1, or through a valley, as can be understood.

Description:

The inverted pivot has four principal features.

Figure 5:
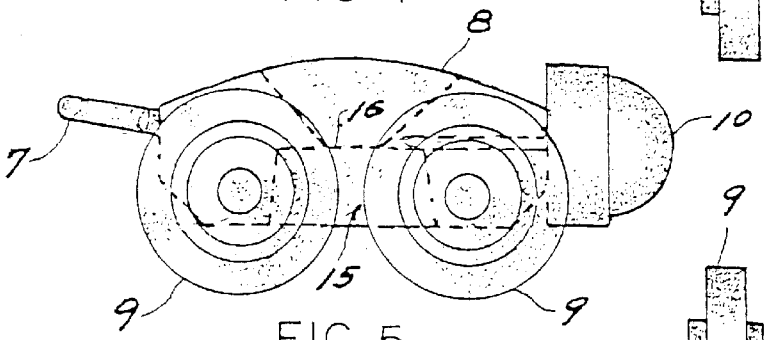
FIG. 5 is a side view thereof.
Figure 8:
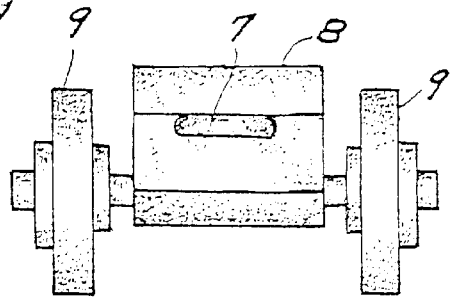
FIG. 8 is a back view thereof.
Figure 6:
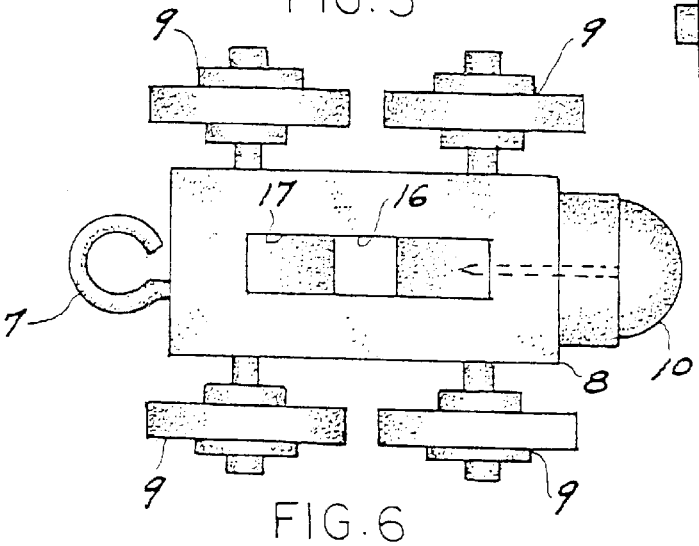
FIG. 6 is a top view of the wheel carriage.

1. Arced Perimeter: See: FIG. 5. This feature is a curved or arced segment of the inverted pivot body's perimeter. It is located at the larger opening of the Pivot Freeway and extends along the block's top perimeter of sufficient distance to assure the desired inverted pivot rotational displacement. The purpose of arced perimeter is to provide a smooth contact surface between the inverted pivot assembly and the bottom of the toy railroad car over a predetermined displacement of the inverted pivot body around the "y" and "z" axis and transverse movement along the "x" axis.
2. Pivot Freeway: See: FIG. 6. This feature is a trough-shaped recess within the inverted pivot body. The freeway is usually "U" shaped in the vertical plane, although any shape allowing adequate rotational and perimeter contact sliding movement would be workable. The bottom of the "U" would contain an opening with sufficient tolerance to accommodate and allow adequate movement of the Attachment Pin. The purpose of the pivot freeway is to allow perimeter movement of the inverted pivot body throughout a predetermined angular displacement in both the "y" and "z" axis and transverse movement along the "x" axis.
3. Attachment Recess: See: FIG. 5. The Attachment Pin head can either be recessed into the inverted pivot body as illustrated or can simply pass through and extend beyond the inverted pivot block depending on the application. The purpose of the attachment recess (if used) is to provide a recess for the head of the attachment pin so as to avoid the pin's extension below the bottom of the pivot block.
4. Attachment Pin: See FIGS. 1 and 9. This feature is merely a screw, bolt or other similar attachment device which allows a permanent attachment of the inverted pivot body to a component body while acting as a pivoting/rotating stationary point allowing adequate rotational movement around the "y" and "z" axis and transverse movement along the "z" axis.

The enclosed drawings contain dimensions and notes applicable only to the manufacture of the mold for this particular toy wooden train wheel truck application and should not be considered as integral to the invention itself.

The enclosed drawings do not depict any of the axle holes nor pilot holes associated with the specific application of the invention to that of the toy wooden train wheel truck assembly.

The invention, when appropriately configured with an arced perimeter, pivot freeway, and attachment pin effectively allows rotational and transverse movement of the assembly around a displaced axis potentially not located within the component itself. The net effect is that the assembly can actually rotate around a dynamic point on its perimeter rather than around an actual rotational axis. Thus, the assembly size can be minimized and yet still provide rotation movement around an axis whose radius may actually be many times the component's dimensions and transverse movement not available with traditional axial applications. Research indicates that in most potential inverted pivot applications, the assembly's net rotational axis point is dynamic and is often actually located well outside of the assembly. Thus, the inverted pivot allows rotation around both the "y" and "z" axis and transverse movement along the "x" axis.

Simply, the invention allows the assembly to slide along its perimeter with the same rotational movement as though the component was actually rotating around a displaced axis. This movement contrasts to a traditionally pivoted component which rotates around a stationary rotational axis located within the component itself.

More specifically, this invention, the inverted pivot, however, uses smaller wheels mounted in inverted pivot wheel trucks. The wheel trucks rotate on their perimeters which require a minimum vertical height to operate. This also maximizes railcar height within the overall height limitation. Since the inverted pivot wheel truck rotates along its perimeter, the railcar can successfully navigate incline transitions (up, down and hump). Lastly, a toy railcar equipped with inverted pivot wheel trucks is much more realistic in appearance than other current wheel truck toy railcars.

Variations and modifications to the subject matter of this invention may become readily apparent to those skilled in the art upon reviewing the disclosure as provided herein. Any variations or modifications thereto, are intended to be encompassed by the scope of the invention as provided. The description of the preferred embodiment is furnished for illustrative purposes only.

I claim:

1. A model railroad car including a car body and a pair of wheel trucks mounted to an underside of the car body by means of an anchor, said wheel trucks being pivotal relative to the car body and including:

a wheel truck body having an outer end, an inner end, an upper surface, a lower surface, a counterbore in the lower surface, and a slot in the upper surface; said lower surface counterbore being in communication with said upper surface slot through a neck opening;

said anchor having a head and a shaft; said head being sized to be received in said counterbore without passing through said neck opening; said anchor shaft extending through said truck body slot and into said car body; said truck body being rotatable about said anchor shaft and pivotal relative to said car body about said anchor head.

2. The model railroad car of claim 1 wherein said slot in said truck body upper surface is an elongated slot.

3. The model railroad car of claim 2 wherein said slot has sloped surfaces.

4. The model railroad car of claim 1 wherein said upper surface is sloped along a longitudinal axis of said car.

5. The model railroad car of claim 1 wherein said truck body includes an attachment point on its respective inner surface; said railroad car including an elastic element connected to said attachment point at an end thereof.

6. A wheel truck body for a model railroad car; said wheel truck body including a curved top surface, a front surface, a back surface, a bottom surface, an elongated slot formed in said top surface, a counterbore in said bottom surface; said counterbore communicating with said slot through a neck; said truck body further including an anchor for attaching the truck body to a model railroad car body, the anchor including a head which is received in the bottom surface counterbore and a shaft which extends through the upper surface slot; said truck body being rotatable about said anchor shaft and pivotal about said anchor head.

* * * * *